US005785438A

United States Patent [19]

Yamaguchi et al.

[11] Patent Number: 5,785,438

[45] Date of Patent: Jul. 28, 1998

[54] RIBBON MASK FOR IMPACT DOT MATRIX PRINTED

[75] Inventors: Naoto Yamaguchi; Hiroshi Ishida; Masayuki Kumazaki; Kazuhiko Yamaguchi; Yukihiro Uchiyama, all of Nagano, Japan

[73] Assignee: Seiko Epson Corporation, Tokyo, Japan

[21] Appl. No.: 706,094

[22] Filed: Aug. 30, 1996

[30] Foreign Application Priority Data

Aug. 30, 1995 [JP] Japan ..... 7-245310
Jun. 27, 1996 [JP] Japan ..... 8-186659

[51] Int. Cl.[6] ..... B41J 35/04

[52] U.S. Cl. ..... 400/248; 400/208; 400/642

[58] Field of Search ..... 400/248, 208, 400/248.1, 247, 642, 645.1

[56] References Cited

U.S. PATENT DOCUMENTS

| | | | |
|---|---|---|---|
| 4,383,775 | 5/1983 | Trammell et al. | 400/208 |
| 4,408,912 | 10/1983 | Yonkers | 400/208 |
| 4,571,102 | 2/1986 | Ono et al. | 400/248 |
| 4,856,923 | 8/1989 | Smith | 400/247 |
| 4,904,098 | 2/1990 | Hamilton | 400/248 |
| 4,960,337 | 10/1990 | Kato et al. | 400/248 |
| 5,366,304 | 11/1994 | Sheehan et al. | 400/248 |

FOREIGN PATENT DOCUMENTS

| | | |
|---|---|---|
| 0 073 114 | 3/1983 | European Pat. Off. . |
| 0 225 498 | 6/1987 | European Pat. Off. . |
| 3502470 C1 | 7/1986 | Germany . |
| 1 280578 | 11/1989 | Japan . |

*Primary Examiner*—Christopher A. Bennett
*Attorney, Agent, or Firm*—Stroock & Stroock & Lavan LLP

[57] ABSTRACT

A ribbon mask for use with a impact dot matrix printer is provided. The ribbon mask comprises a head confronting surface and a pair of opposed side plates each positioned on an opposite side of the head confronting surface. An obtuse angle is formed between said head confronting surface each of the opposed side plates. A pair of fitting tabs are also provided. Each fitting tab is positioned on one of the pair of opposed side plates. An acute angle is formed between each of the fitting tabs and a plane parallel to a plane in which the head confronting surface lies. As a result of this construction, when the ribbon mask comes in contact with a sheet of a recording medium, the ribbon mask is deformed so that a portion of the head confronting surface comes into contact with an end of a recording head, which in turn prevents the ribbon mask from interfering with the sheet of the recording medium.

9 Claims, 4 Drawing Sheets

RIBBON MASK FOR IMPACT DOT MATRIX PRINTED

BACKGROUND OF THE INVENTION

The invention relates to generally to ribbon masks and more particularly to ribbon masks used for impact dot matrix printers.

The use of ribbon masks in prior art impact dot matrix printers is well known in the art. A prior art ribbon mask a for use with impact dot matrix printers is shown in FIG. 4, and is designed so that a pair of fitting tabs b, b extend from mask a which are dimensioned to be fitted into corresponding grooves g, g of a ribbon mask holder *f*. Each of fitting tabs b, b are formed so as to project from each side of ribbon mask a, and to extend parallel with a flat surface e of ribbon mask a. Grooves g, g are recessed within each side of ribbon mask holder *f*. Ribbon mask a is bent into a trapezoidal shape in plan so that flat surface e thereof can be maintained in contact with a recording medium to be printed upon, while allowing fitting tabs b, b to be fitted into corresponding grooves g, g. Fitting tabs b, b are retained within grooves g, g by dowels i, i extending from mask holder *f*. Ribbon mask a is further formed with a mask hole d formed therein to allow print wires from the impact dot matrix printer to pass therethrough when a printing operation is being performed. In this way ribbon mask a is mounted on a carriage and is positioned to reciprocate when a printing operation is being performed.

Ribbon mask a is formed of an extremely thin steel plate whose thickness ranges from about 0.05 to 0.1 mm. Thus, if the carriage travels in the direction indicated by arrow X in FIG. 4 during use so that recording data will be written on a sheet of, for example, a fanfold comprising at lease one perforation or gather j, an internal edge of ribbon mask a which forms mask hole d may catch perforation or gather j. Therefore, the movement of ribbon mask a is impeded, and ribbon mask a is pulled away from mask holder *f*. A print head confronting surface c of ribbon mask a is forced in the direction opposite to the traveling direction (opposite arrow X in FIG. 4) when ribbon mask a comes into contact with perforation or gatherj projecting from the surface of the recording medium. As a result, a portion e of the head confronting surface c on the downstream side of mask hole d as viewed in the traveling direction (the direction of arrow X in FIG.4) is separated from an end of a print head h. Thus, perforation or gather j can enter further into mask hole d. This in turn may further impede the movement of ribbon mask a, thereby causing ribbon mask a to disconnect from dowels i and move from its correct position. Therefore, printing quality will be effected, and the printing operation must be stopped to reposition ribbon mask a. Thus, it would be beneficial to provide a novel ribbon mask that can smoothly slide along a recording sheet without being caught on perforations or gathers contained on the recording medium during a printing operation.

SUMMARY OF THE INVENTION

Generally speaking, in accordance with the invention, a ribbon mask for use with an impact dot matrix printer is provided. The ribbon mask comprises a head confronting surface and a pair of opposed side plates each disposed on an opposite side of the head confronting surface to form a trapezoid when viewed in plan. An obtuse angle is formed between the head confronting surface and each of the opposed side plates. A pair of fitting tabs are also provided. Each fitting tab is positioned on one of the pair of opposed side plates. An obtuse angle is formed between each of the fitting tabs and the corresponding side plate.

As a result of this construction, when the ribbon mask comes into contact with a sheet of a recording medium during a printing operation, the ribbon mask is deformed obliquely so that the tab on the downstream side of the head confronting surface comes into contact with a wall of the ribbon mask holder. The head confronting surface is maintained in contact with the end of the print head, which in turn allows the print head to smoothly slide along a sheet of a recording medium without causing interference between the mask hole and the recording medium. At the same time, the tab on the upstream side of the ribbon mask is deformed and is forced along the upper surface of the corresponding engaging groove, which in turn contributes to reinforcing the engagement of the dowel with the tab to insure that the ribbon mask will not be separated from the dowel and the ribbon mask holder.

BRIEF DESCRIPTION OF THE DRAWINGS

For a fuller understanding of the invention, reference is had to the following description taken in connection with the accompanying drawings, in which:

FIG. 3(*b*) is an enlarged sectional view depicting the ribbon mask and printer head when in operation.

DETAILED DESCRIPTION OF THE PREFERRED EMBODIMENTS

Figure 1:
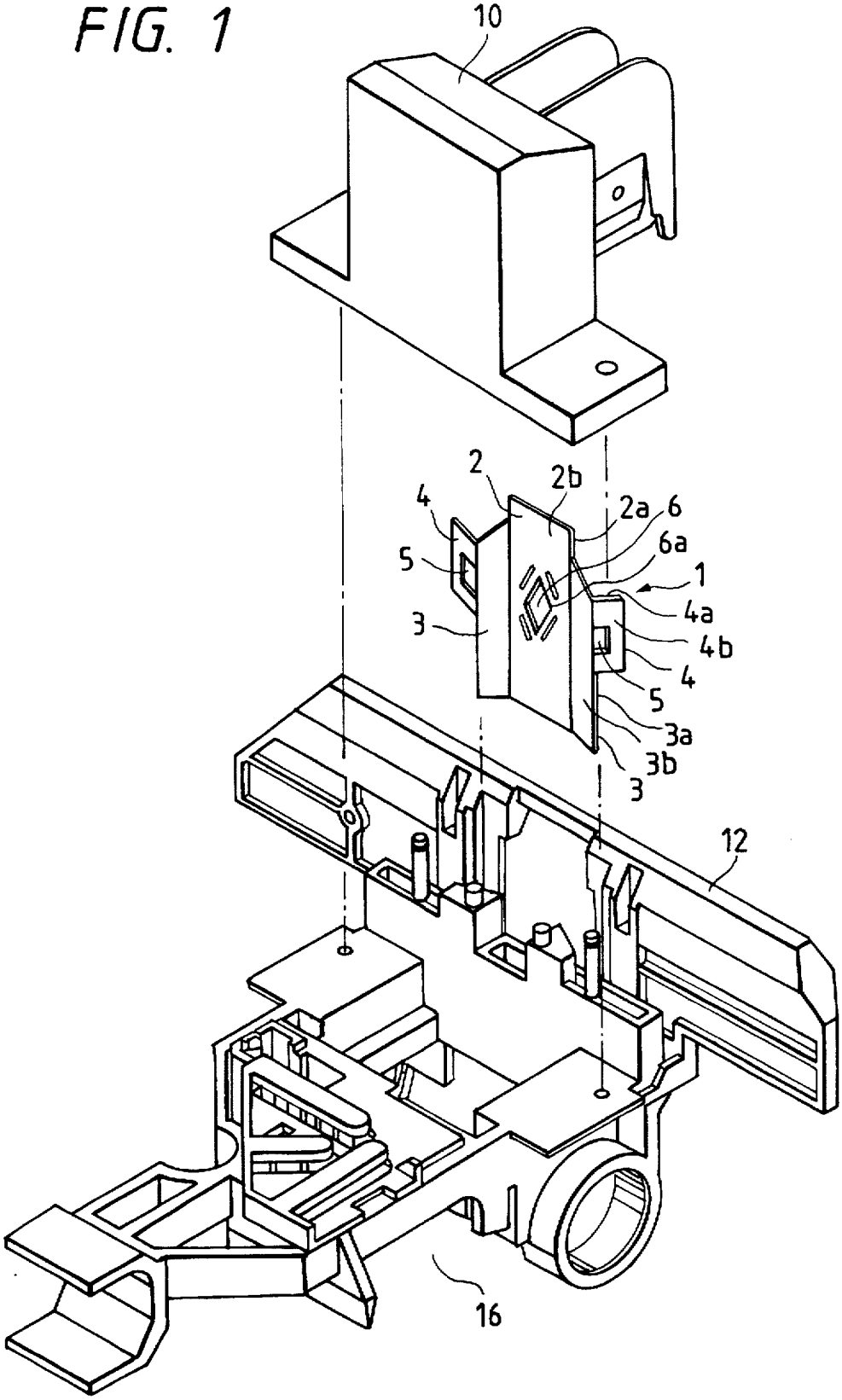
FIG. 1 is an exploded perspective view depicting a ribbon mask and carriage assembly constructed in accordance with the invention and an associated printer head.
Figure 2:
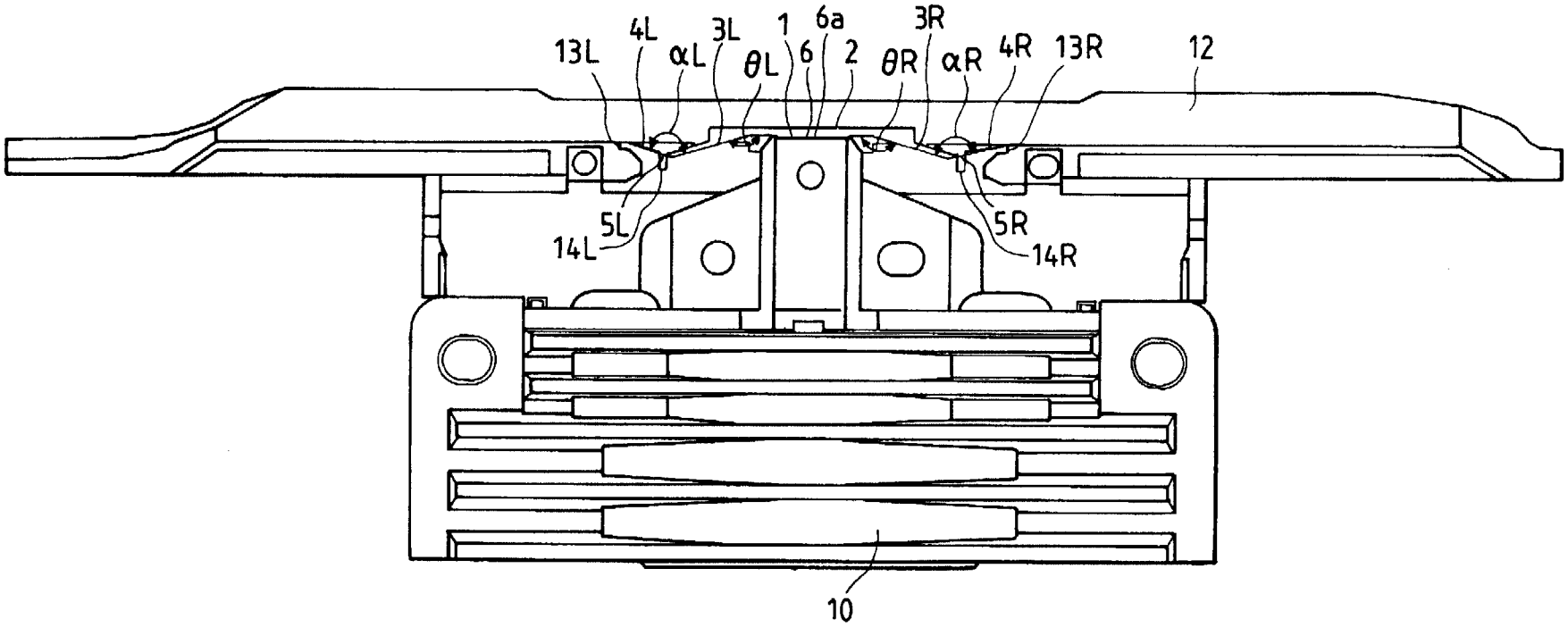
FIG. 2 is a top plan view of the ribbon mask and printer head of FIG. 1.

Reference is first made to FIGS. 1 and 2, in which a ribbon mask is indicated generally as 1. Ribbon mask 1 is formed of a metal plate with a thickness of approximately 0.06 mm. Ribbon mask 1 is constructed so as to be roughly trapezoidal when viewed in plan. Ribbon mask 1 includes a head confronting surface 2 having a front surface 2*a* and a back surface 2*b* is disposed between side plates 3L, 3R arranged on either side head confronting surface 2. Side plates 3L, 3R are each formed with a front surface 3*a* and a back surface 3*b*, and are slightly inclined relative to head confronting surface 2 toward a print head 10.

Ribbon mask 1 is further formed with fitting tabs 4L, 4R formed on either side thereof, each having a front surface 4*a* and a back surface 4*b*. Fitting tabs 4L, 4R project outward from either end edge of side plates 3L, 3R respectively, so that an acute angle is formed between fitting tab 4L, 4R and a plane P' parallel to the plane P in which head confronting surface 2 lies. Further, fitting tab 4L is formed so that front surface 3*a* of side plate 3L and front surface 4*a* of fitting tab 4L form an obtuse angle $\alpha L$. Similarly, fitting tab 4R is formed so that front surface 3*a* of side plate 3R and front surface 4*a* of side plate 4R form an obtuse angle $\alpha R$. In an exemplary embodiment $\alpha L$ and $\alpha R$ are of greater than 168° and thus side plates 3L, 3R project toward a platen and a sheet of a recording medium S (FIG. 3(*a*)).

Fitting tabs 4L, 4R are further formed with engaging holes 5L, 5R. Ribbon mask 1 is further formed with a mask hole 6 that allows print wires to be passed therethrough while a printing operation is being performed. Ribbon mask 1, along with ribbon mask holder 12 and the entire print head, is mounted on a carriage 16 which allows for the reciprocal motion of the components during a print operation. In an exemplary embodiment mask 1 is formed as a unitary piece.

A ribbon mask holder 12 is formed on a carriage 16. Fitting grooves 13L, 13R arranged on either side of the back surface of ribbon mask holder 12. Fitting grooves 13L, 13R extend parallel with the surface of ribbon mask holder 12. A pair of corresponding dowels 14L, 14R are arranged at the entrances of fitting grooves 13L, 13R and engage fitting holes 5L, 5R during use. Dowels 14L, 14R project toward print head 10, so that ribbon mask 1 can be attached to ribbon mask holder 12.

Figure 3A:
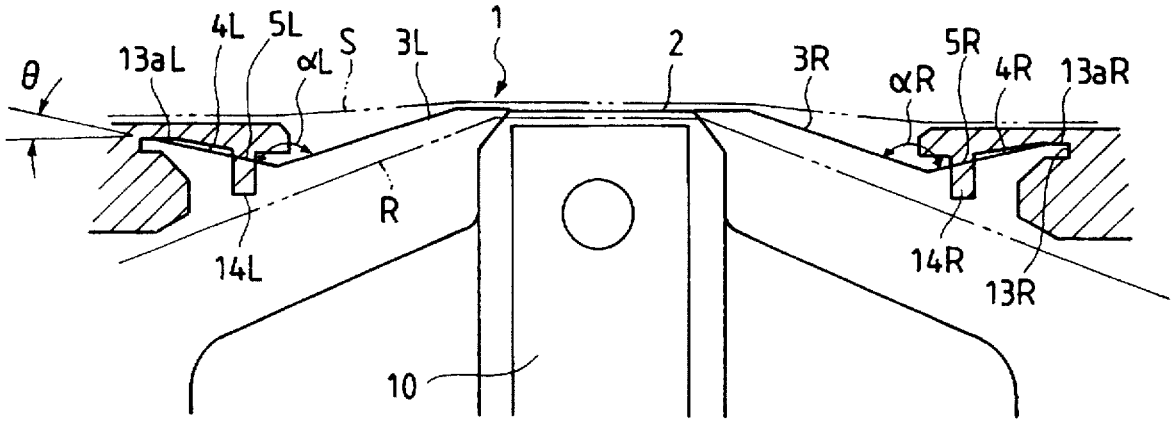
FIG. 3(*a*) is an enlarged sectional view depicting the ribbon mask and printer head when not in operation.
Figure 3B:
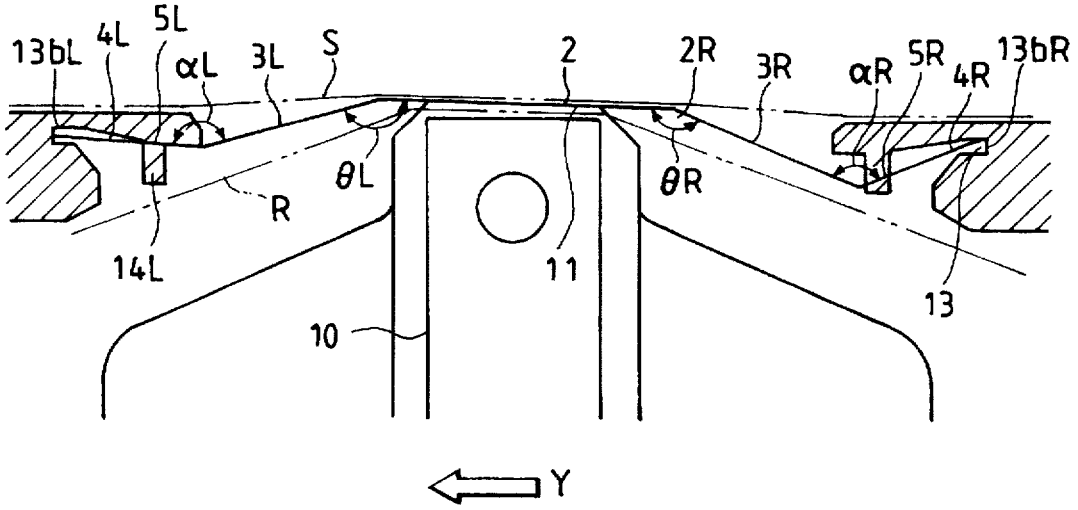
Figure 4:
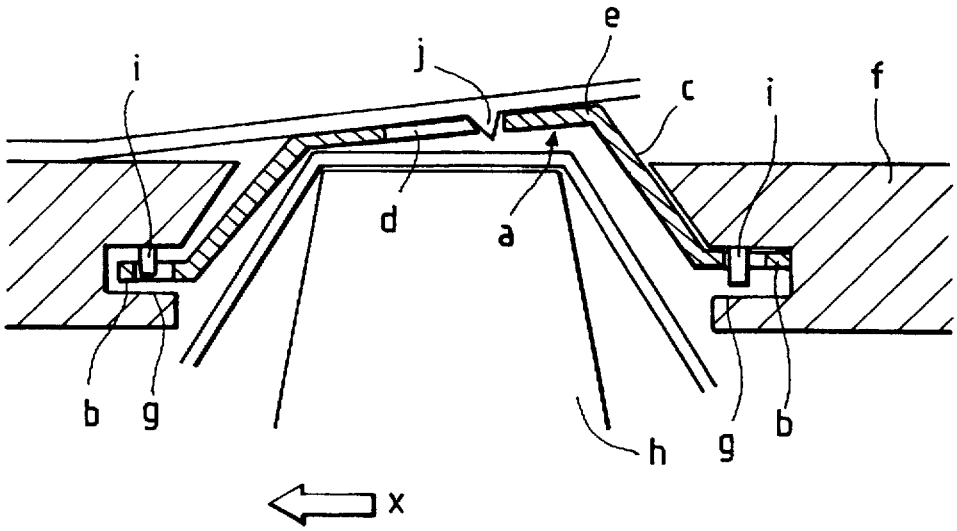
FIG. 4 PRIOR ART
FIG. 4 is an enlarged sectional view depicting the functioning of a prior art ribbon mask.

Now referring to FIG. 3(*a*), when the carriage is inoperative and a print operation is not being performed, fitting tabs 4L, 4R, which as noted above project toward a platen (not shown) from each of side plates 3L, 3R and form obtuse angles αL, αR therewith, support ribbon mask 1 so that head confronting surface 2 of ribbon mask 1 is positioned to properly extend along the end of print head 10 disposed on carriage 16. The ends of fitting tabs 4L, 4R are maintained in pressured contact with inner surfaces 13*a*L, 13*a*R of fitting grooves 13L, 13R and are maintained within narrow fitting grooves 13L, 13R. The pressured contact between the ends of fitting tabs 4L, 4R, and inner surfaces 13*a*L, 13*a*R of narrow fitting grooves 13L, 13R causes and maintains head confronting surface 2 to be properly positioned, and to properly extend along the end of print head 10.

When a print operation is being performed, carriage 1 travels in the direction indicated by arrow Y, as shown in FIG. 3(*b*). During this print operation, data is recorded on a recording medium, and head confronting surface 2 of ribbon mask 1 is displaced slightly in the direction opposite to the traveling direction (opposite to the direction indicated by arrow Y). As a result, fitting tab 4R (the fitting tab positioned in the downstream direction from head confronting surface 2) is forced against an inner wall 13*b*R of corresponding fitting groove 13R. Side plate 3R (the side plate positioned in the downstream direction from head confronting surface 2) is forced toward print head 10 and the angle αR is decreased. This in turn will cause an angle θR formed between a portion 2R of head confronting surface 2 and side plate 3R, on the downstream side of head confronting surface 2 to decrease, thereby drawing side plate 3R toward print head 10 and in turn insuring that head confronting surface 2 will remain in contact with an end 11 of print head 10.

Thus, even if a perforation or gatherj is caught up by an edge portion 6*a* of mask hole 6, this perforation or gather is pushed away from edge portion 6*a* by contact with the surface of the ink ribbon R located immediately below the mask hole 6, between print head 10 and ribbon mask 1, the ink ribbon being further supported by print head 10. Because ribbon mask 1 is maintained against end 11 of print head 10, print head 10 forces any perforation or gather j out of mask hole 6. As a result, smooth passage of ribbon mask 1 over a perforated, or other non-smooth surface is not impeded.

Also during a printing operation, side plate 3L (the side plate positioned in the upstream direction from head confronting surface 2) is pulled in the direction opposite that indicated by arrow Y in FIG. 3(*b*). This force causes the end of tab 4L (the fitting tab positioned in the upstream direction from head confronting surface 2) to be pulled away from upper surface 13*b* of corresponding fitting groove 13 while increasing angle αL and also increasing an angle θL formed between confronting surface 2 and side plate 3L. This increasing of these angles increases the engaging force between fitting tab 4L and dowel 14L, and also insures that no leverage will allow ribbon mask 1 to be detached from mask holder 12. Thus, during a printing operation, ribbon mask 1 will be deformed, thereby increasing the angles αL, θL on the upstream side of the print head, and decreasing the angles aR, OR on the downstream side of the print head, and ribbon mask 1 is properly maintained against end 11 of print head 10.

Thus, the present invention is characterized in that tabs are arranged on either side of the main body of a ribbon mask. The main body is formed as a shallow trapezoid with a head confronting surface in the middle thereof, and the tabs are bent and inclined towards a platen. The tabs are designed to be fitted into a ribbon mask holder. As a result of this construction, when the ribbon mask comes into contact with a sheet of a recording medium during a printing operation, the ribbon mask is deformed obliquely so that the tab on the downstream side of the head confronting surface comes into contact with a wall of the ribbon mask holder, and the head confronting surface is maintained in contact with the end of the print head, which in turn allows the print head to smoothly slide along a sheet of a recording medium without causing interference between the mask hole and the recording medium. At the same time, the tab on the upstream side of the ribbon mask is deformed and is forced along the upper surface of the corresponding engaging groove, which in turn contributes to reinforcing the engagement of the dowel with the tab to insure that the ribbon mask will not be separated from the dowel and the ribbon mask holder.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed:

1. A ribbon mask for use with an impact dot matrix printer, comprising:

a flat head confronting surface having a front surface and a back surface and lying in a plane;

a pair of opposed side plates, each having a front surface and a back surface, each positioned on an opposite side of said head confronting surface, an obtuse angle being formed between said back surfaces of said opposed side plates and said back surface of said head confronting surface, and wherein an imaginary straight line parallel to said head confronting surface and intersecting said pair of opposed side plates substantially forms a trapezoid with said side plates and said head confronting surface when viewed in plan;

a pair of fitting tabs, each having a front surface and a back surface and an end surface, each positioned on a respective one of said pair of opposed side plates, an obtuse angle being formed between said front surfaces of said opposed side plates and said front surfaces of said pair of fitting tabs, wherein said front surfaces of said pair of fitting tabs are bent to extend in a direction towards the plates of said back surface of said head confronting surface, an acute angle being formed between each of said front surfaces of said fitting tabs and a plane parallel to said plane in which said head confronting surface lies.

2. The ribbon mask of claim 1, wherein each of said fitting tabs is dimensioned to engage a respective engaging groove on said printer.

3. The ribbon mask of claim 2, further comprising engaging holes formed in each of said fitting tabs.

4. The ribbon mask of claim 3, wherein said engaging holes are each dimensioned to engage a dowel on said printer.

5. The ribbon mask of claim 1, wherein said ribbon mask is formed of a thin metal plate.

6. The ribbon mask of claim 5, wherein said thin metal plate is approximately 0.06 mm thick.

7. The ribbon mask of claim 1, wherein said ribbon mask is bent into a shallow trapezoidal form.

8. The ribbon mask of claim 1, wherein said acute angle between said parallel plane and said front surfaces of said associated fitting tabs is greater than 12°.

9. The ribbon mask of claim 8, wherein said ribbon mask is dimensioned to permit said obtuse angles to change during a print operation of said impact dot matrix printer.

* * * * *

UNITED STATES PATENT AND TRADEMARK OFFICE

CERTIFICATE OF CORRECTION

PATENT NO. : 5,785,438
DATED : July 28, 1998
INVENTOR(S) : Naoto Yamaguchi, Hiroshi Ishida, Masayuki Kumazaki, Kazuhiko Yamaguchi, Yukihiro Uchiyama It is certified that error appears in the above-indentified patent and that said Letters Patent is hereby corrected as shown below:

ON THE TITLE PAGE

Change "[54] RIBBON MASK FOR IMPACT DOT MATRIX PRINTED " to

--[54] RIBBON MASK FOR IMPACT DOT MATRIX PRINTER--

Signed and Sealed this

Twenty-seventh Day of April, 1999

*Attest:*

Q. TODD DICKINSON

*Attesting Officer*

*Acting Commissioner of Patents and Trademarks*